US005511656A

United States Patent [19]

Olsen

[11] Patent Number: 5,511,656

[45] **Date of Patent: *Apr. 30, 1996**

[54] CARRIER STOCK HAVING FINGER-GRIPPING STRAPS CURVED INWARDLY TOWARD EACH OTHER

[75] Inventor: Robert C. Olsen, Madinah, Ill.

[73] Assignee: Illinois Tool Works Inc., Glenview, Ill.

[ * ] Notice: The term of this patent shall not extend beyond the expiration date of Pat. No. 5,305,877.

[21] Appl. No.: 292,604

[22] Filed: Aug. 18, 1994

[51] Int. Cl.[6] ..... B65D 71/50

[52] U.S. Cl. ..... 206/150; 206/151

[58] Field of Search ..... 206/147, 149, 206/150, 151, 158, 161, 162, 192, 197, 831

[56] References Cited

U.S. PATENT DOCUMENTS

| | | | |
|---|---|---|---|
| 3,959,949 | 6/1976 | Benno et al. | 53/35 |
| 4,219,117 | 8/1980 | Weaver | 206/150 |
| 4,250,682 | 2/1981 | Braun | 53/48 |
| 4,269,308 | 5/1981 | Platt | 206/150 |
| 4,545,480 | 10/1985 | Klygis | 206/151 |
| 4,548,317 | 10/1985 | Weaver | 206/162 |
| 4,592,466 | 6/1986 | Walters et al. | 206/150 |
| 4,624,363 | 11/1986 | Edwards | 206/161 |
| 4,752,001 | 6/1988 | Olsen | 206/831 |
| 4,911,289 | 3/1990 | Bird | 206/151 |
| 5,060,999 | 10/1991 | Marvin | 206/192 |
| 5,098,144 | 3/1992 | Marvin | 206/197 |
| 5,305,877 | 4/1994 | Olsen | 206/151 |

FOREIGN PATENT DOCUMENTS

| | | | |
|---|---|---|---|
| 9012742 | 11/1990 | WIPO | 206/150 |

*Primary Examiner*—Jimmy G. Foster
*Attorney, Agent, or Firm*—Dressler, Goldsmith, Shore & Milnamow, Ltd.

[57] ABSTRACT

Carrier stock for beverage cans or other cans of a type having a chime at an upper end and having a frusto-conical wall below the chime is formed from a single sheet of resilient polymeric material, such as low density polyethylene, with band segments defining can-receiving apertures, with webs extending generally transversely and separating the can-receiving apertures in each longitudinal row, and with finger-gripping straps arranged in pairs and configured such that each strap of each pair extends generally transversely between two of the inner band segments and is curved inwardly toward the other strap of the same pair. Each finger-gripping strap has two legs, each being connected not only with an inner band segment but also with a connecting web, which extends therefrom, which extends generally along an inner band segment, and which connects such leg with a separating web. At each leg, connecting web, and inner band segment, the carrier stock may have a dividing slit or a dividing aperture. In a package comprising the carrier and associated cans, some of the lifting forces imparted to the finger-gripping straps are distributed to the separating webs through the connecting webs, so as to reduce tendencies of the carrier to peel off the cans where the finger-gripping straps are connected.

5 Claims, 2 Drawing Sheets

FIG. 4
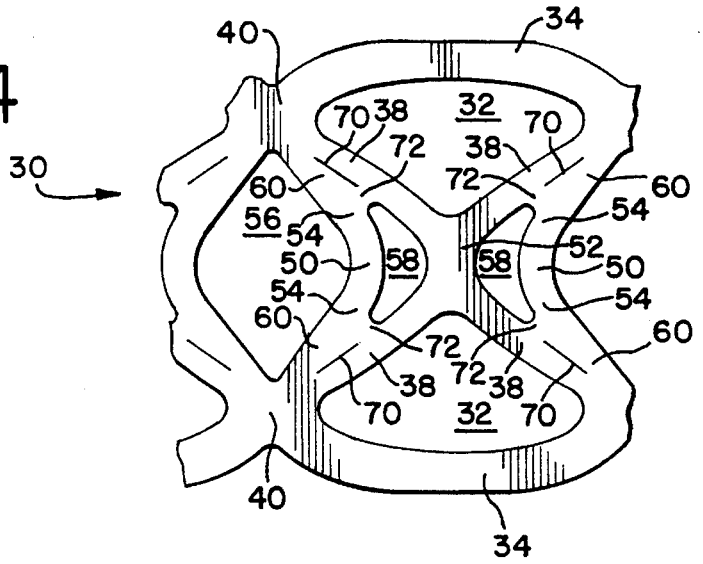
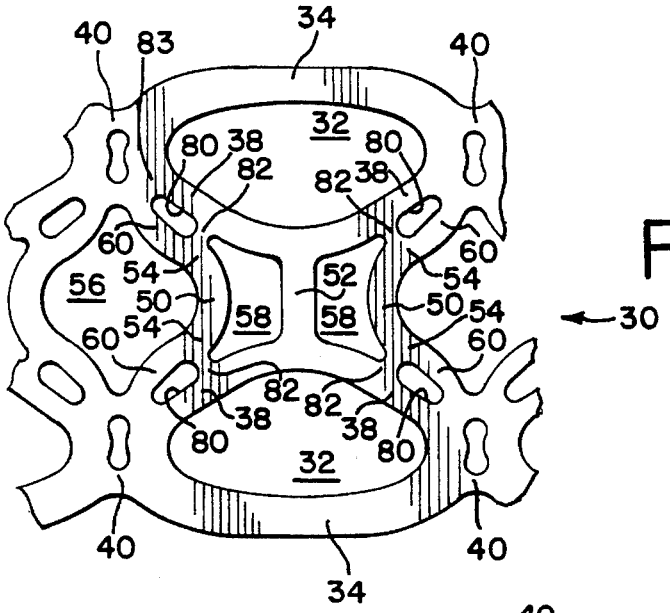
FIG. 5
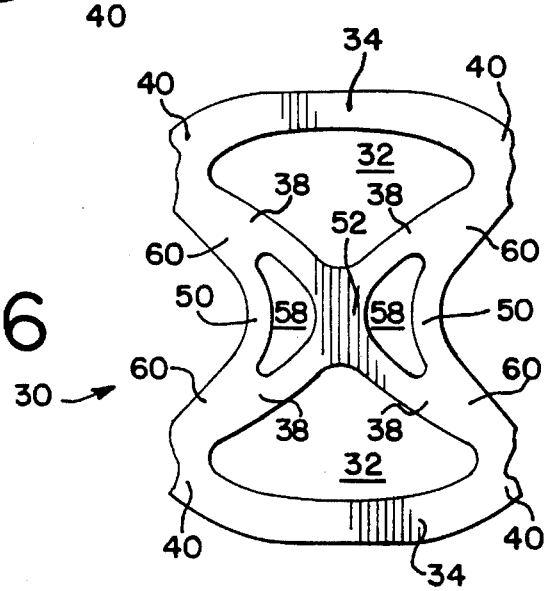
FIG. 6

CARRIER STOCK HAVING FINGER-GRIPPING STRAPS CURVED INWARDLY TOWARD EACH OTHER

TECHNICAL FIELD OF THE INVENTION

This invention pertains to carrier stock for substantially identical cans, such as beverage cans, of a type having a chime and an-inwardly tapered neck below the chime. The carrier stock is formed from a single sheet of resilient polymeric material, such as low density polyethylene, so as to have pairs of finger-gripping straps. The finger-gripping straps of each pair are curved inwardly toward each other.

BACKGROUND OF THE INVENTION

Carrier stock as exemplified in Weaver et al. U.S. Pat. No. 4,219,117 and Benno et al. U.S. Pat. No. 3,959,949 is employed commonly for machine application, typically with machines described in Braun U.S. Pat. No. 4,250,682 or other similar jaw and drum machines, to substantially identical cans, such as beverage cans utilized commonly to contain beer and soft drinks. Such cans have annular chimes at their upper ends, cylindrical side walls, and frusto-conical walls between the chimes and the side walls. Such stock is formed, as by die-cutting, from a single sheet of resilient polymeric material, such as low density polyethylene.

Typically, such stock has integrally joined band segments including outer band segments and inner band segments and defining can-receiving apertures in longitudinal rows and transverse ranks, along with separating webs extending generally transversely when the carrier stock is in a flat, unstressed condition. The separating webs separate the can-receiving apertures in each longitudinal row. When such stock is applied effectively, the band segments defining the can-receiving apertures grip the frusto-conical walls of the cans tightly and engage the lower edges of the chimes.

Such stock also may have finger-gripping straps arranged in pairs. As known heretofore, the finger-gripping straps have generally straight edges and extend generally transversely between two of the inner band segments when the carrier stock is in a flat, unstressed condition. It is intended for a user to grip one pair of the finger-gripping straps with the thumb and forefinger of one hand for lifting a package comprising a rectangular array of such cans and a carrier severed from such stock and applied to the cans in the rectangular array.

Such finger-gripping straps may also function to transfer laterally directed stretching forces from outer bands to inner bands, as suggested in Weaver et al. U.S. Pat. No. 4,219,117.

Can manufacturers have introduced cans having smaller chime diameters, as compared to the diameters of the side walls, which cans are known as "necked-in" cans. Some newer versions of these necked-in cans further and drastically-reduce the ratio of the chime diameter and the side wall diameter.

In a necked-in can of a newer type, the frusto-conical wall between the chime and the side wall defines a conical angle greater than-approximately 28°, and in some instances as great as approximately 37°. Moreover, some recently introduced, necked-in cans are taller and have a greater capacity, as compared to prior cans of the type noted above.

A package comprising a carrier severed from carrier stock of the type noted above and such necked-in cans, particularly but not exclusively such taller cans of greater capacity, has presented a problem that is addressed by this invention. The ability to reduce thickness of carrier stock to obtain economies could also present a problem.

Specifically, there has been a tendency for the carrier to peel off the cans where such finger-gripping straps join such inner band segments, because of lifting forces transmitted by such finger-gripping straps to such inner band segments.

Another problem associated with carrier stock for machine application to necked-in cans is addressed in Olsen U.S. Pat. No. 5,305,877.

SUMMARY OF THE INVENTION

This invention addresses the aforenoted problem and provides improvements in carrier stock for machine application to substantially identical cans of the type noted above. This invention also provides an improved package comprising a carrier severed from the carrier stock, as improved by this invention, and such cans in a generally rectangular array comprising longitudinal rows and transverse ranks.

As formed from a single sheet of resilient polymeric material, such as low density polyethylene, the carrier stock is formed with outer band segments and inner band segments. The outer and inner band segments define can-receiving apertures in a generally rectangular array having longitudinal rows and transverse ranks. The carrier stock is formed with separating webs extending generally transversely when the carrier stock is in a flat, unstressed condition and separating the can-receiving apertures in each longitudinal row. The carrier stock is formed with finger-gripping straps arranged in pairs.

In accordance with this invention, the finger-gripping straps are configured such that each finger-gripping strap of each pair extends generally transversely between two of the inner band segments and is curved inwardly toward the other finger-gripping strap of the same pair when the carrier stock is in a flat, unstressed condition.

Each finger-gripping strap may have two legs interconnected with an arcuate center section. The extremities of the legs may be also connected with inner band segments and with separating webs through connecting webs, creating a connection region that permits forces to be transmitted not only to the inner band segments but also to the separating webs.

In one contemplated embodiment, each connecting web defines an uninterrupted web. In another contemplated embodiment, each connecting web is interrupted by an elongate slit, which divides the associated one of the inner band segments partly from the associated leg. In another contemplated embodiment, each connecting web is interrupted by an elongate aperture, which divides the associated one of the inner band segments partly from the associated leg.

Additionally, the carrier stock may have reinforcing straps, one of which extends generally transversely between the finger-gripping straps of each pair, the finger-gripping straps being curved inwardly toward the reinforcing straps when the carrier is in a flat, unstressed condition.

These and other objects, features, and advantages of this invention are evident from the following description of several contemplated embodiments of this invention with reference to the accompanying drawings.

BRIEF DESCRIPTION OF THE DRAWINGS

FIGS. 4, 5, and 6 are fragmentary details of carrier stocks according to other contemplated embodiments of this invention.

DETAILED DESCRIPTION OF ILLUSTRATED EMBODIMENTS

Figure 2:
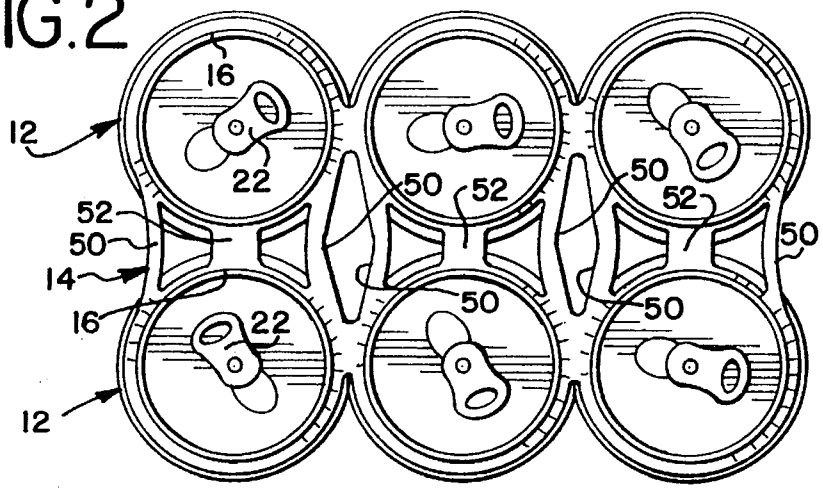
FIG. 2 is a top, plan view of the same package, substantially as shown in FIG. 1.
Figure 1:
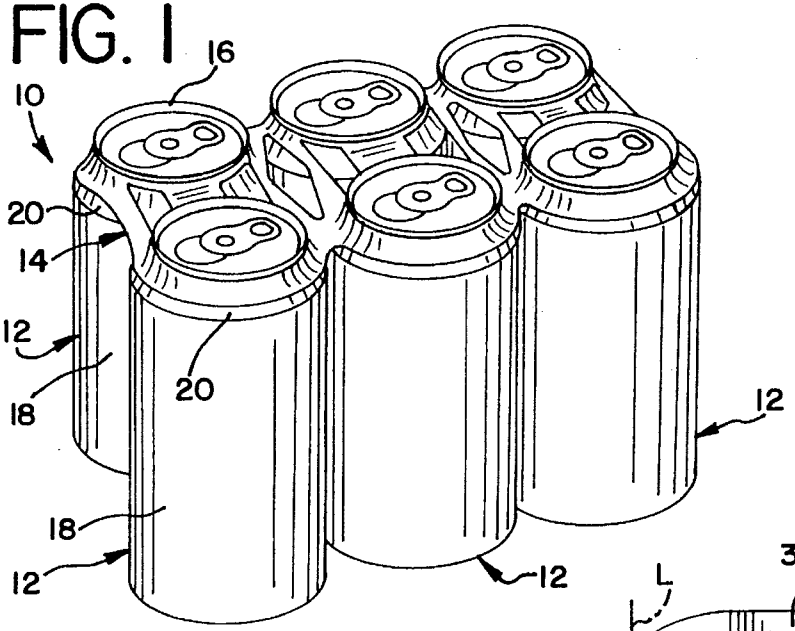
FIG. 1 is a perspective view of a package comprising six substantially identical cans of the type noted above and a carrier severed from a carrier stock according to one contemplated embodiment of this invention.

As shown in FIGS. 1 and 2, a package 10 comprises six substantially identical, necked-in cans 12 of the type noted above and a carrier 14, which is severed from a carrier stock according to a first embodiment of this invention. Each can 12 has an annular chime 16 of a given diameter, a cylindrical side wall 18 of a larger diameter, and a frusto-conical wall 20 between the annular chime 16 and the cylindrical side wall 18. The annular chime 16, the cylindrical side wall 18, and the frusto-conical wall 20 define a can axis. The upper end of each can 12 has a pull tab 22. Generally, since each can 12 is of the newer type noted above, the frusto-conical wall 20 of such can 12 may define a conical angle greater than 28° relative to the can axis.

Figure 3:
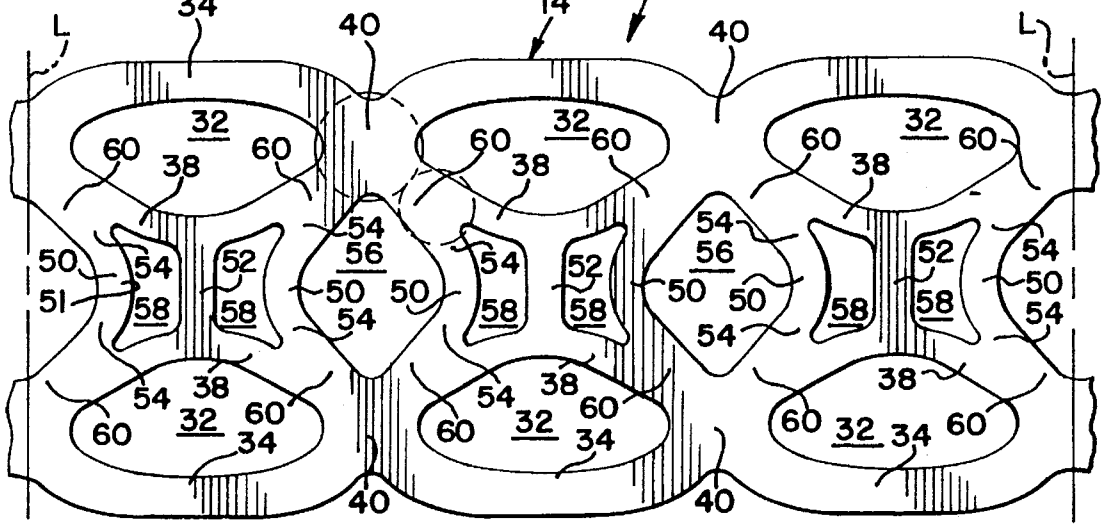
FIG. 3 is a top, plan view of the carrier stock in a flat, unstressed condition.

As shown in FIG. 3, the carrier stock 30 according to the first embodiment of this invention is formed in an indeterminate length, as by die-cutting, from a single sheet of resilient polymeric material. A preferred material is low density polyethylene. A preferred thickness for such stock 30 in an unstressed condition, if low density polyethylene is used, is in a range from approximately 16 mils to approximately 17.5 mils. The carrier stock 30 is severable along transverse lines L to form individual carriers exemplified by the carrier 14. The lines L may be preslitted or prescored to facilitate severing the carrier stock 30.

The carrier stock 30 is formed, for each individual carrier 14, with integrally joined band segments defining six can-receiving apertures 32 in a rectangular array with two longitudinal rows and with three transverse ranks. The apertures 32 are elongated in the longitudinal direction of the carrier stock 30 to facilitate opening of the carrier stock 30 into a generally circular configuration upon application of transverse application forces.

The band segments include outer segments 34 extending longitudinally, in two longitudinal rows, with each outer segment 34 partly bounding one of the can-receiving apertures 32. The band segments also include inner segments 38 extending longitudinally, in two longitudinal rows, with each inner segment 38 partly bounding one of the can-receiving apertures 32.

The carrier stock 30 is formed with separating webs 40, which extend generally transversely when the carrier stock 30 is in a flat, unstressed condition, and which separate the can-receiving apertures in each longitudinal row. Each separating web 40 is joined integrally to the ends of two outer segments 34 and to the ends of two inner segments 38. Each line L extends across and divides two separating webs 40. In FIG. 3, an exemplary one of the separating webs 40 is indicated generally by the larger, dashed circle.

The carrier stock 30 is formed with clusters of band segments or straps configured so as to extend generally transversely when the carrier stock is in a flat, unstressed condition, such straps including finger-gripping straps 50 arranged in pairs and reinforcing straps 52. Each finger-gripping strap 50 has two legs 54 and an arcuate center section 51 between the legs 54. Each reinforcing strap 52 is interposed between the finger-gripping straps 50 of a respective pair. The carrier stock 30 is formed with additional apertures including a finger-admitting aperture 56 between each cluster and the next cluster and two smaller apertures 58 within each cluster.

In accordance with this invention, such straps are configured such that each finger-gripping strap 50 of each pair is curved inwardly toward the other finger-gripping strap 50 of the same pair through the arcuate center section 51 between the legs 54 (without engaging the reinforcing strap 52 interposed between the finger-gripping straps 50 of the same pair) when the carrier stock 30 is in a flat, unstressed condition. Each leg 54 of each finger-gripping strap 50 is connected not only with an associated one of the inner segments 38 but also with a separating web 40.

A connecting web 60 extends from such leg 54, generally along the associated one of the inner segments 38, and connects such leg with an associated one of the separating webs 40 and with an associated one of the inner segments 38. Each connecting web 60 defines an uninterrupted web. In FIG. 3, an exemplary one of the connecting webs 60 is indicated generally by the smaller, dashed circle.

The carrier stock 30 permits the can-receiving apertures 32 to be opened to generally circular configurations, generally in a manner disclosed in Weaver et al. U.S. Pat. No. 4,219,117, the disclosure of which is incorporated herein by reference.

When a user grips one pair of the finger-gripping straps 50 of such a carrier 14 with the thumb and forefinger of one hand for lifting such a package 10, the connecting webs 60 at the legs 54 of the gripped straps 50 distribute some of the lifting forces to the separating webs 40 connected to the same connecting webs 60 so as to reduce tendencies of the carrier 14 to peel off the cans 12 where the gripped straps 50 are connected to certain of the inner band segments 38. The straps 50 may not be curved in the finished package, since the outer edges of the straps 50 may be tensioned.

In a second embodiment, as shown in FIG. 4, each leg 54, the associated one of the inner band segments 38, and the connecting web 60 connecting such leg 54 with the associated one of the separating webs 40 and with an associated one of the inner band segments 38 are interrupted by an elongate slit 70, which divides the associated one of the inner band segments 38 partly from the connecting web 60 connecting such leg 54 with the associated one of the separating webs 40. A bridge 72 of the polymeric material of the carrier stock 30 connects such leg 54 and the connecting web 60 to the associated one of the inner band segments 38. The inner band segments present a generally V-shaped configuration to reduce the lateral distance between containers in the finished package.

In a third embodiment, as shown in FIG. 5, each leg 54, the associated one of the inner band segments 38, and the connecting web 60 connecting such leg 54 with the associated one of the separating webs 40 are interrupted by an elongate aperture 80. A bridge 82 of the polymeric material of the carrier stock 30 connects such leg 54 and the connecting web 60 connecting such leg 54 with the associated one of the separating webs 40 to the associated one of the inner band segments 38. Each of the connecting webs 60 is connected to one of the separating webs 40 at a bridge 83. Each of the separating webs 40 has an elongate aperture 84, which extends generally transversely when the carrier stock 30 is in a flat, unstressed condition.

In the first embodiment, as shown in FIG. 3, and in the third embodiment, as shown in FIG. 5, each reinforcing strap 52 is straight with parallel edges when the carrier stock 30 is in a flat, unstressed condition. In the second embodiment, as shown in FIG. 4, and in a fourth embodiment, as shown in FIG. 6, each reinforcing strap 52 is hourglass-shaped with inwardly curved edges when the carrier stock 30 is in a flat, unstressed condition. Moreover, in the second and fourth embodiments, the inner band segments 38 are configured so as to be generally chevron-shaped when the carrier stock 30 is in a flat, unstressed condition. Otherwise, the fourth embodiment is similar to the first embodiment, as illustrated and described.

Various other modifications may be made without departing from the scope and spirit of this invention.

I claim:

1. Carrier stock for machine application to substantially identical cans of a type having a chime at an upper end and having a frusto-conical wall below the chime, the carrier stock being formed from a single sheet of resilient polymeric material and being formed with outer band segments and inner band segments, said outer and inner band segments defining can-receiving apertures in a generally rectangular array having two longitudinal rows and transverse ranks, the carrier stock being formed with separating webs extending generally transversely when the carrier stock is in a flat, unstressed condition and separating the can-receiving apertures in each longitudinal row, the carrier stock being formed with finger-gripping straps arranged in pairs and configured such that each finger-gripping strap of each pair extends generally transversely between two of the inner band segments and has a center section curved inwardly toward the other finger-gripping strap of the same pair when the carrier stock is in a flat, unstressed condition, wherein each finger-gripping strap has two legs interconnected with the center section thereof, which center section is arcuate, each leg having an extremity connected not only with an associated one of the inner band segments but also with a separating web through a connecting web.

2. The carrier stock of claim 1 wherein each connecting web defines an uninterrupted web.

3. The carrier stock of claim 1 wherein each connecting web is interrupted by an elongate slit, which divides the associated one of the inner band segments partly from the associated leg.

4. The carrier stock of claim 1 wherein each leg, the associated one of the inner band segments, the separating web, and the connecting web are interrupted by an elongate aperture, which divides the associated one of the inner band segments partly from the associated leg.

5. The carrier stock of claim 1 formed so as to have reinforcing straps, one of which extends generally transversely between the finger-gripping straps of each pair, the finger-gripping straps being curved inwardly toward the reinforcing straps when the carrier is in a flat, unstressed condition.

* * * * *